US007740380B2

(12) United States Patent
Thrailkill

(10) Patent No.: US 7,740,380 B2
(45) Date of Patent: Jun. 22, 2010

(54) SOLID STATE LIGHTING APPARATUS UTILIZING AXIAL THERMAL DISSIPATION

(76) Inventor: John E. Thrailkill, 92 Thrush Way, Shelburne, VT (US) 05482

( * ) Notice: Subject to any disclaimer, the term of this patent is extended or adjusted under 35 U.S.C. 154(b) by 0 days.

(21) Appl. No.: 12/260,661

(22) Filed: Oct. 29, 2008

(65) Prior Publication Data

US 2010/0103667 A1 Apr. 29, 2010

(51) Int. Cl.
*F21V 29/00* (2006.01)

(52) U.S. Cl. ..... 362/294; 362/373; 362/249.02; 362/800

(58) Field of Classification Search ..... 362/373, 362/294, 800, 249.02, 249.03
See application file for complete search history.

(56) References Cited

U.S. PATENT DOCUMENTS 6,517,221 B1 * 2/2003 Xie ..... 362/373
6,910,794 B2 * 6/2005 Rice ..... 362/547
7,300,187 B2 * 11/2007 Huang et al. ..... 362/373
7,431,475 B2 * 10/2008 Hafuka et al. ..... 362/218
7,488,093 B1 * 2/2009 Huang et al. ..... 362/294
7,494,249 B2 * 2/2009 Li ..... 362/294
7,543,960 B2 * 6/2009 Chang et al. ..... 362/294
7,547,124 B2 * 6/2009 Chang et al. ..... 362/373
2009/0097241 A1 * 4/2009 Xu et al. ..... 362/234

* cited by examiner

*Primary Examiner*—Anabel M Ton
(74) *Attorney, Agent, or Firm*—Cesari and McKenna, LLP

(57) ABSTRACT

A solid state lighting apparatus characterized by its compact, predominately axial form factor, utilizes an axial thermal transfer member constructed of Highly Oriented Pyrolytic Graphite (HOPG) to aid in the dissipation of waste heat generated during its operation. The lighting apparatus is chiefly comprised of a Light Emitting Diode (LED) die array and circuit structure assembly affixed to one end of the axial thermal transfer member and further includes a transversely mounted heat sink structure, running the length of, and being affixed to, opposite sides of the axial member. The axial member serves to distribute waste heat down its length, and simultaneously, into a transverse plane where the waste heat is dissipated into the transversely mounted heat sink structure. A fan may be utilized to evacuate the waste heat out of the lighting apparatus and into the ambient environment.

26 Claims, 5 Drawing Sheets

SOLID STATE LIGHTING APPARATUS UTILIZING AXIAL THERMAL DISSIPATION

BACKGROUND OF THE INVENTION

1. Field of the Invention

The present invention relates generally to high intensity, solid state lighting devices. More particularly, the invention relates to the use of a primarily axial thermal dissipation system to provide for a compact, high intensity, solid state lighting device with a predominantly axial overall form factor.

The present invention further relates to the use of a primarily axial thermal dissipation system to provide for a compact, high intensity, solid state lighting device with a comparatively low profile overall form factor.

2. Background Information

High intensity light sources are widely used in projection systems, television backlights, automotive headlamps and other devices that require a relatively compact, high output light source. Some applications require a high intensity light source with limited Etendue (the product of light source area and solid-angle of light output). For these applications, the light emitting source itself must be as small as possible to achieve the highest efficiencies. Furthermore, some of these applications may have the additional requirement for a lighting device with a particular overall form factor, such as a predominately axial (long and slender) form factor, or alternatively, a comparatively low profile (thin and wide) form factor. Examples of applications that require an illumination source with limited Etendue and a particularly demanding device form factor are ultra-compact image projectors, surgical headlights and hand held light curing wands.

Generally, High Intensity Discharge (HID) lamps have been used heretofore in high intensity light sources due to their high photonic output and high photonic conversion efficiencies. In operation, however, these devices are hindered by relatively short operating lifetimes, erratic performance, catastrophic failure that can interfere with automatic or man-life dependent operations and the production of high levels of radiated and convected waste heat which can negatively affect the objects of illumination. In addition, applications that require a lighting device with a particularly compact or otherwise demanding form factor may require supplementary light guide structures, such as fiber optics, in order to locate the light source remotely, relative to the object of illumination.

As products that require light sources have become increasingly compact and in many cases more portable, the need has arisen for compact, reliable, solid state illumination sources. These sources, typically based on Light Emitting Diode (LED) technology, offer longer operating lifetimes, predictable performance, more predictable and manageable failure modes and tunable spectral output. In addition, the waste heat generated by an LED is primarily conductive in nature and with proper design, can be dissipated with little or no affect on the object of illumination.

A major shortcoming of the current state of the art of LED technology, however, is its inability to produce adequate levels of illumination in applications that require a high intensity lighting device with a particularly demanding overall form factor, such as a compact, predominately axial form factor or a compact, low profile form factor. These devices lack the required thermal dissipation mechanisms to adequately eliminate the waste heat that is being generated. This is especially true for applications that require a limited Etendue. For these applications, the LED dies must be grouped into closely spaced arrays. This close spacing results in a large thermal flux, exacerbating the thermal dissipation challenges.

It is therefore a principal object of the present invention to provide a high intensity, solid state lighting apparatus that is characterized by its ability to dissipate a large thermal flux while maintaining a compact, predominately axial form factor.

It is a further object of the present invention to provide a high intensity, solid state lighting apparatus that is characterized by its ability to dissipate a large thermal flux while maintaining a compact, low profile form factor.

SUMMARY OF THE INVENTION

In accordance with the present invention, an apparatus is provided for enhanced thermal dissipation of waste heat generated by a closely spaced array of LED dies. In particular, the present invention enables the lighting apparatus to achieve a compact, predominantly axial form factor or, alternatively, a compact, low profile form factor.

To aid in the description of the present invention, the components that comprise the lighting apparatus are segregated into two main groups, the Internal and External Component Groups. The primary function of the Internal Component Group is to generate light and dissipate the resulting waste heat. The primary function of the External Component Group is to evacuate the waste heat into the ambient environment and to create and maintain thermal contact with the internal components and to protect the internal components from damaging external forces.

The Internal Component Group is generally comprised of the following: a Light Emitting Diode (LED) die array and circuit structure assembly (the LED die array being affixed to the component side of the circuit structure), a reflecting optic element, an axial thermal transfer member and a transverse heat sink structure (transversely mounted to the axial member).

The External Component Group is generally comprised of the following: an exterior housing (a set of exterior half-shells, an exterior top plate and an exterior bottom plate), a system of transverse compression pads, an axial compression spring and spring clamp and, optionally, an axial flow fan (or other type of forced convection device).

Elements of the Internal Component Group operate as a system in the following way: light generated by the LED die array is focused and projected by the reflecting optic element (said the optic element being affixed to the component side of the LED die array and circuit structure assembly). Waste heat generated by the LED die array is spread throughout the thermally conductive circuit structure and into an end face of the axial thermal transfer member (the end face being in physical contact with the underside of the circuit structure).

The axial thermal transfer member is preferably constructed of Highly Oriented Pyrolytic Graphite (HOPG), a material comprised of a plurality of parallel graphene sheets, or layers. HOPG is characterized as highly thermally anisotropic, exhibiting very high thermal conductivity (on the order of 1500 Watts/Meter·Kelvin) within the plane of the graphene layers, while exhibiting relatively low thermal conductivity (on the order of 25 Watts/Meter·Kelvin) in the transverse direction. The axial member is preferably rectangular in cross section and constructed such that the graphene layers are arranged in parallel fashion with respect to the main axis of the axial member.

As waste heat is conducted into the end face of the axial member, the very high thermal transfer rate within the plane of the graphene layers results in a rapid transfer of waste heat down the length of the axial member, and simultaneously, into the transversally mounted transverse heat sink structure, where the waste heat is further diffused throughout the heat sink structure (the heat sink structure being in physical contact with two opposed, axially aligned sides of the axial thermal transfer member).

This thermal transfer system is preferably designed to operate in conjunction with an axial flow fan (or other type of forced convection device) as part of an active, forced convection cooling system, whereby a fluid medium, in the present case air, is forced through the transverse heat sink structure, thereby convectively evacuating the waste heat into the ambient environment.

The axial flow fan (or other type of forced convection device) is an element of the broader External Component Group. Other elements of this group operate in conjunction with the Internal Component Group in the following way: with the transverse compression pads adhered to the inside surfaces of the two outer housing shells, the housing shells are brought together around the Internal Component Group such that a transverse compression load is developed between the axial thermal transfer member and the transverse heat sink structure (the compression load being applied in the plane of the graphene layers and transverse to the main axis of the axial member). So arranged, the housing shells are affixed in position with mechanical fasteners. With the top end plate fastened to the housing shells, the axial compression spring and spring clamp are assembled into the housing shell such that an axial compression load (coaxial with respect to the main axis of the axial thermal transfer member) is developed between the axial member and the LED die array and circuit structure assembly (with the reflecting optic element acting as a mechanical stop between the circuit structure assembly and the top end plate). So arranged, the bottom end plate and axial flow fan (or other type of forced convection device) are mechanically fastened to the housing shell.

In this way, the External Component Group serves to create and maintain a high degree of thermal contact between the LED die array and circuit structure assembly and the axial thermal transfer member and the transverse heat sink structure. In addition, it serves to evacuate waste heat from said transverse heat sink structure into the ambient environment and to protect the Internal Component Group from damaging external forces.

The foregoing and other objects, features and advantages of the present invention will become readily apparent to those skilled in the art from the following detailed description wherein embodiments of the invention are shown and described by way of illustration. As will be realized, the invention is capable of other and different embodiments and its several details may be capable of modifications in various aspects, all without departing from the scope of the invention as defined by the appended claims. Accordingly, the drawings and description are to be regarded as illustrative in nature and not in a restrictive or limiting sense with the scope of invention being defined by the claims.

DETAILED DESCRIPTION OF AN ILLUSTRATIVE EMBODIMENT

The present invention is generally directed to high intensity solid state lighting devices. In particular, the invention relates to the use of a primarily axial thermal dissipation system in order to provide for a lighting apparatus with a predominately axial device form factor, or alternatively, a low profile device form factor.

Figure 8:
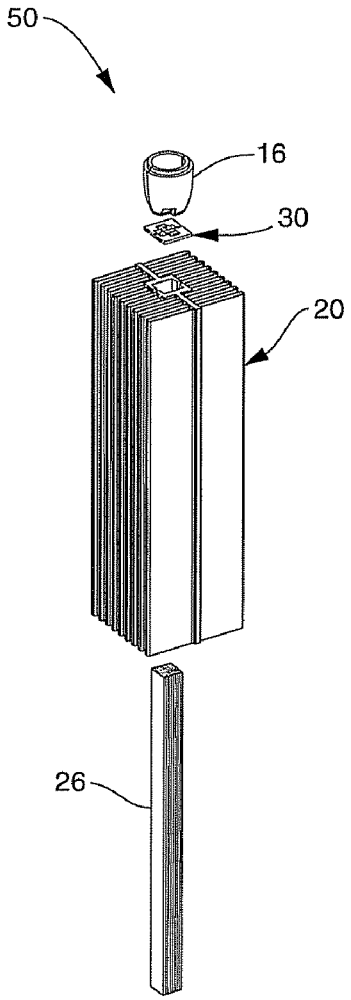
FIG. 8 is a partially exploded view of the components and assemblies that comprise the Internal Component Group.
Figure 9:
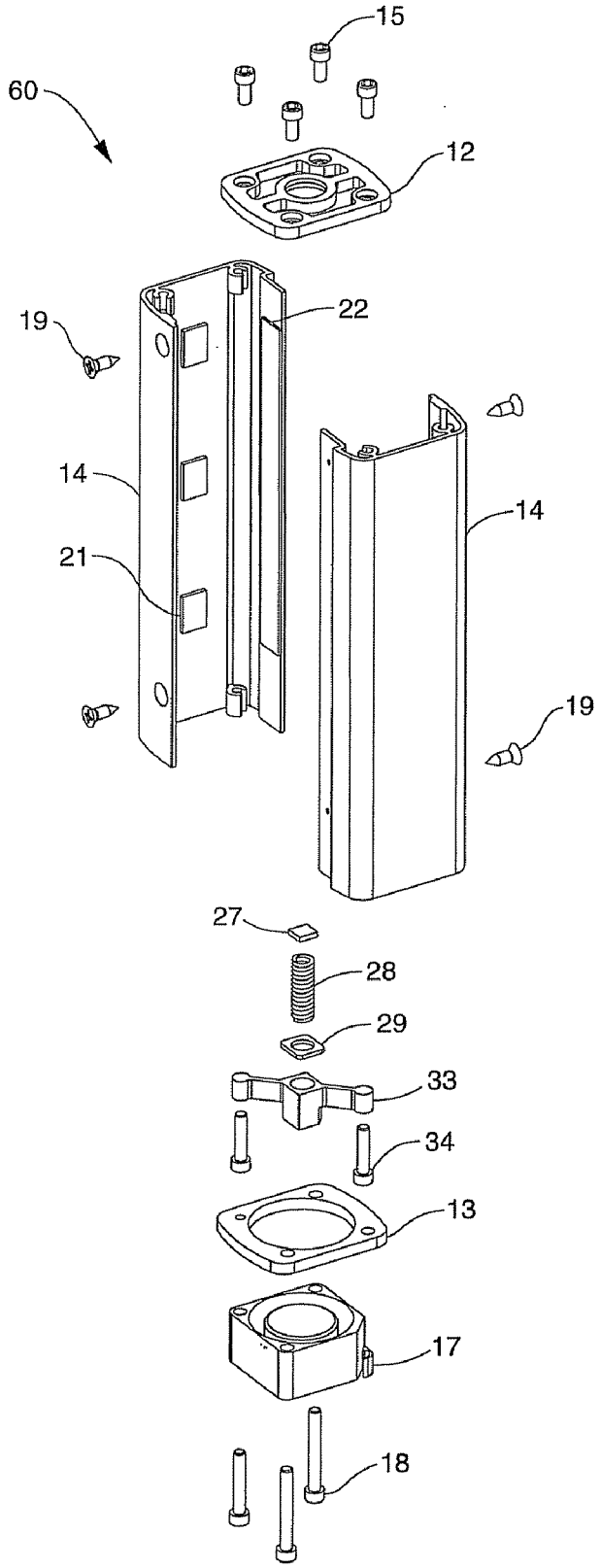
FIG. 9 is a partially exploded view of the components that comprise the External Component Group.

With reference now to the attached drawings, FIGS. 1-4 & FIG. 7 illustrate a high intensity solid state lighting apparatus 10 in accordance with one embodiment of the invention. The lighting apparatus is generally comprised of two functional component groups, the internal component group 50 (shown in FIG. 8) and the external component group 60 (shown in FIG. 9).

These component groups contribute to the functioning of the lighting apparatus in the following ways: the internal component group 50 serves to generate light and to dissipate the resulting waste heat into an internal structure; the external component group 60 serves to transfer the waste heat away from the internal structure and into the ambient environment; the external component group 60 also serves to create and maintain thermal contact between the parts and assemblies that comprise the internal component group 50 and to protect the internal components from damaging external forces.

The internal component group 50 is comprised of the following parts and assemblies: the LED die array and circuit structure assembly 30, the reflecting optic element 16, the axial thermal transfer member 26 and the transverse heat sink structure 20.

Figure 5:
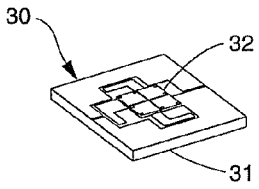
FIG. 5 is a perspective view of the LED die array and circuit structure assembly in accordance with the present invention.

Elements of the internal component group 50 operate as a system in the following way: the LED die array and circuit structure assembly 30 (shown in FIG. 5) is an assemblage of an LED die array 32 and a circuit structure 31. The LED die array 32 is affixed to the circuit structure 31 utilizing a die attachment process, commonly known in the art, such as silver-epoxy bonding or eutectic soldering. The circuit structure 31, commonly known in the art, is comprised of a thermally conductive, dielectric ceramic substrate with electrically conductive metallic layers adhered to the top (component) side of the substrate.

The LED die array 32 presented in the current embodiment consists of four individual LED dies placed adjacent to each other on the circuit structure 31, with the placement resulting in a square array. The LED dies are placed as closely to each other as is practical within the limits of the die placement and die attachment processes. However, they are not placed so close as to cause electrical shorting between adjacent dies.

The present embodiment of the invention utilizes an LED die known in the art as a vertically structured die. Vertical structure refers to the current flow in the LED dies; electrical current flows vertically upwards from a bottom surface anode through the device and out to cathode wire bond termination pads on the top surface. Wire bonding is an electrical interconnect technology commonly known in the art.

In other embodiments, an LED die with the anode and cathode termination pads both mounted on the top surface, may be employed. A lighting apparatus utilizing this type of die would require a different circuit structure design.

The circuit structure 31 is duly constructed to provide solder termination pads for the soldering of wire leads as supplied by a suitable external power supply device (not shown). These soldered wire terminations provide electrical interconnection between the LED die array and circuit structure assembly 30 and the external power source. The circuit structure 31 is also duly constructed to provide termination pads for wire bonding. These wire bonds provide electrical interconnection between the LED die array 32 and the circuit structure 31.

Figure 7:
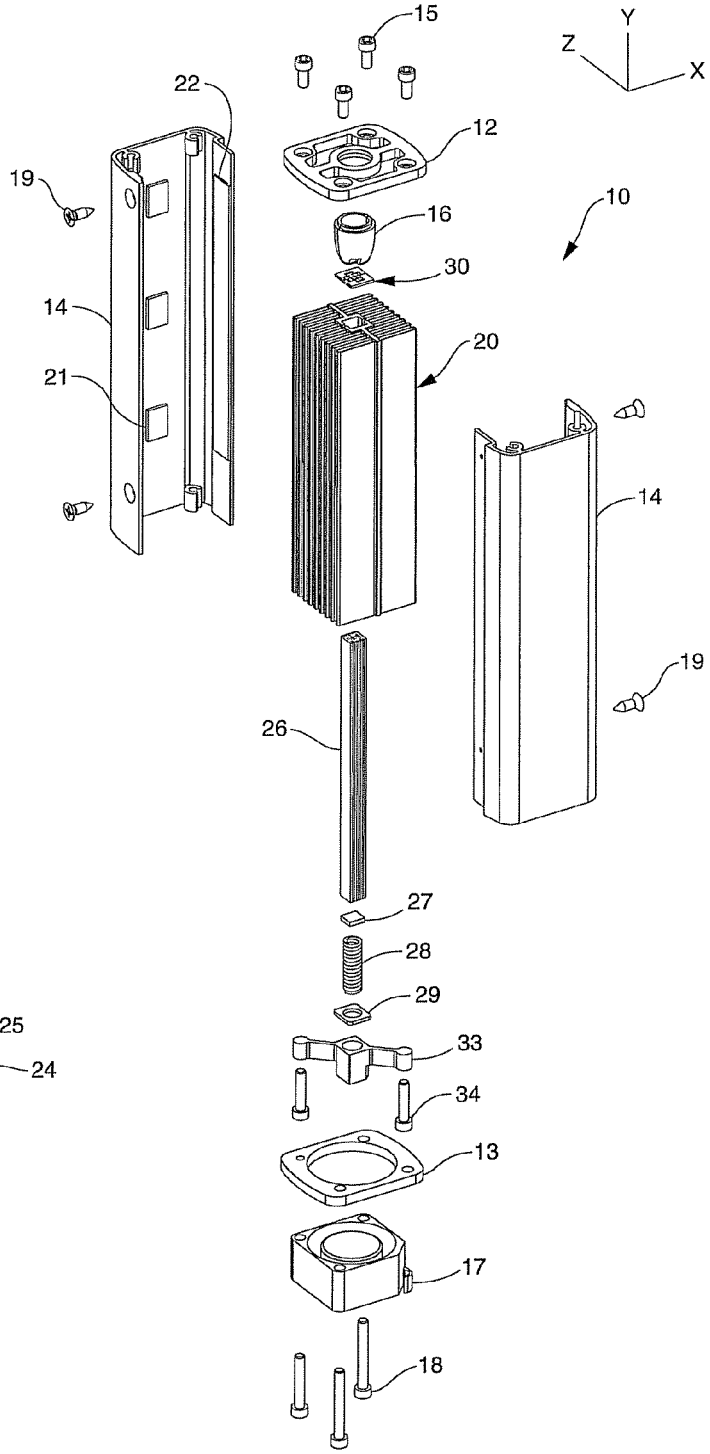
FIG. 7 is an exploded view of a high intensity solid state lighting apparatus in accordance with the present invention.

In the embodiment described, the reflecting optic element 16 (shown in FIGS. 1-4 and FIGS. 7 and 8) is characterized as a first-surface reflector where the reflective surface is formed as a surface of revolution (being revolved about an axis in the Y direction, as seen in FIG. 7). The reflecting optic element 16 is designed to collimate the light emanating from the LED die array 32, and belongs to a class of paraboloid reflectors well known in the art.

In other embodiments of the present invention, a variety of optical reflector designs may be employed to provide a range of illumination solutions. For instance, an ellipsoidal reflector may be used to focus the light, emanating from the LED die array 32, to a point a short distance from the end of the reflecting optic element 16.

In a preferred embodiment of the present invention, the reflecting optic element 16 is formed through the mating of two identical component halves, such that the components mate along the XY plane. This design approach presents the advantage of being able to form component geometries that would be impossible otherwise.

The reflecting optic element 16 can be produced utilizing a number of fabrication processes commonly known in the art. For example, injection molding of engineering thermoplastics can be utilized with an additional metallizing process and machining of various metals can be employed with an additional polishing process. Appropriate metallizing processes include vacuum deposition of aluminum and electroplating of various metals, depending upon the need.

In another embodiment of the same invention, the reflecting optic element 16 is alternatively formed as a single component.

To mechanically affix the reflecting optic element 16 to the LED die array and circuit structure assembly 30, an electrically insulating, thermally stable adhesive system is used to bond the optic element and the circuit structure assembly together.

During operation, waste heat generated by the LED die array 32 is conducted into, and spread laterally throughout, the thermally conductive circuit structure 31. The waste heat is subsequently conducted into an end face of the axial thermal transfer member 26 (the end face being in physical contact with the underside of the circuit structure 31). The aforementioned lateral spreading of waste heat throughout the circuit structure 31 (in particular, in the direction parallel to the X axis, as seen in FIG. 7) is critical to the efficient transfer of the waste heat into the axial thermal transfer member 26 due to the axial member's low thermal conductivity in the direction parallel to the X axis, as explained in more detail below.

The axial thermal transfer member 26 is rectangular in cross section and is constructed of Highly Oriented Pyrolytic Graphite (HOPG); a material comprised of a plurality of parallel graphene sheets, or layers. HOPG is characterized as highly thermally anisotropic, exhibiting very high thermal conductivity (on the order of 1500 Watts/Meter·Kelvin) within the plane of the graphene layers (parallel to the YZ plane, as seen in FIG. 7), while exhibiting relatively low thermal conductivity (on the order of 25 Watts/Meter·Kelvin) in the transverse direction (parallel to the X axis, as seen in FIG. 7).

As waste heat is conducted into the end face of the axial thermal transfer member 26, the very high thermal conductivity within the planes of the graphene layers (parallel to the YZ plane, as seen in FIG. 7), results in a rapid transfer of waste heat down the length of the axial member and simultaneously out to opposite sides (sides parallel to the XY plane) of the axial thermal transfer member 26. The waste heat is subsequently conducted into the transverse heat sink structure 20 (the heat sink structure being in physical contact with the two sides of the axial thermal transfer member 26 that are parallel to the XY plane) where it can be further diffused throughout the entire transverse heat sink structure 20, as described below.

Figure 6:
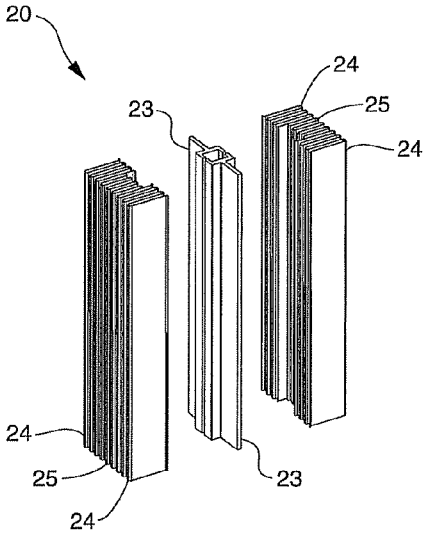
FIG. 6 is a partially exploded view of a transverse heat sink structure exhibiting a predominately axial form factor in accordance with the present invention.

In a preferred embodiment of the present invention, the transverse heat sink structure 20 (see FIG. 6) is formed as an assemblage of the following components: two each of a heat sink base 23, four each of an outer folded-fin component 24 and two each of an inner folded-fin component 25.

The heat sink base 23 is fabricated from aluminum utilizing an aluminum extrusion process, a process commonly known in the art. The heat sink base 23 is comprised of a three sided channel section and a transversely oriented rib section (transverse to the lengthwise axis of the channel section, see FIG. 6). The outer folded-fin components 24 and inner folded-fin components 25 are fabricated from aluminum or copper, depending upon the need, utilizing a folded-fin process, a process also commonly known in the art, where a continuous sheet metal strip is folded repeatedly in a pleat-like fashion so as to form a corrugated fin structure. The base ends of the four outer folded-fin components 24 and the base ends of the two inner folded-fin components 25 are soldered to the two heat sink bases 23 resulting in the transverse heat sink structure 20 (as seen in FIG. 7). As an alternative to soldering, a bonding process utilizing a thermally conductive epoxy (or other appropriate adhesive system) can be used to attach the folded-fin components to the heat sink bases.

In an alternative embodiment of the present invention, a bonded-fin fabrication process, a process that is also commonly known in the art, is utilized to form a transverse heat sink structure comprised of a pair of grooved aluminum or copper heat sink bases (the heat sink bases being formed with grooved outer surfaces) and a plurality of aluminum or copper thermal dissipation fins, in sheet form. The alternative transverse heat sink structure is formed when the plurality of thermal dissipation fins are adhesively bonded, or soldered, into the grooves formed in the aforementioned heat sink bases.

In another alternative embodiment of the present invention, an aluminum extrusion process is utilized to form a transverse heat sink structure comprised of a pair of integrated base-fin structures, where the integrated base-fin structures are formed as a single component during the extrusion process.

In another alternative embodiment of the present invention, an injection molding process, a process also commonly known in the art, is utilized to form a transverse heat sink structure comprised of a pair of integrated base-fin structures, where the integrated base-fin structures are formed as a single component during the injection molding process. The material used to create the transverse heat sink is of a special class of thermally conductive, thermoplastic compounds, commonly known in the art. Such thermoplastic compounds are typically comprised of metallic particles dispersed into a thermoplastic matrix.

Figure 10:
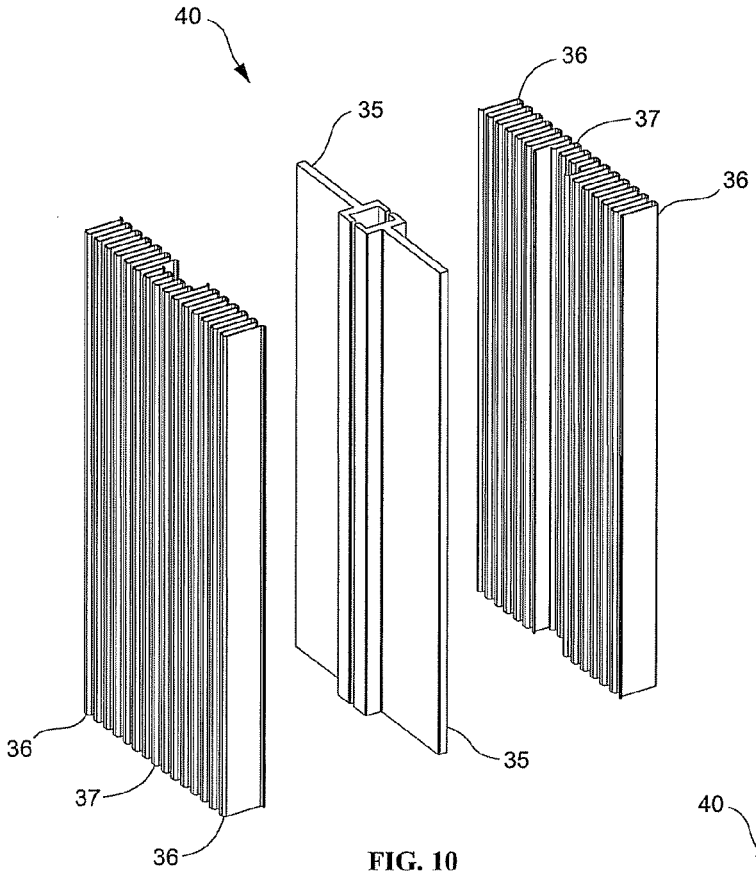
FIG. 10 is a partially exploded view of a transverse heat sink structure exhibiting a comparatively low profile form factor in accordance with the present invention.
Figure 11:
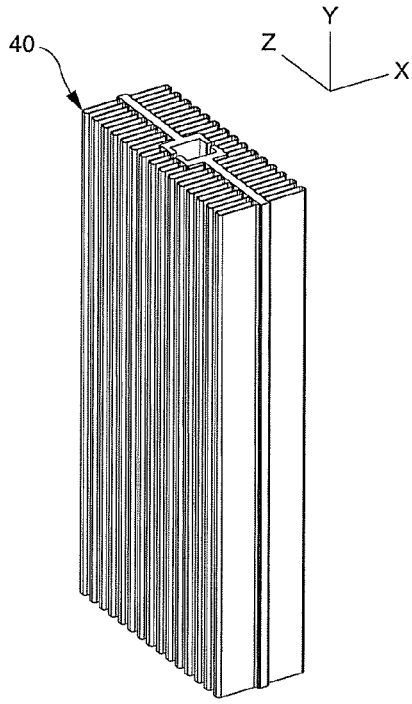
FIG. 11 is a perspective view of a transverse heat sink structure exhibiting a comparatively low profile form factor in accordance with the present invention.

In another embodiment of the present invention, the aspect ratio (width over thickness) of the transverse heat sink structure 20 is altered to produce a low profile (thin) version of the heat sink structure, namely the low profile transverse heat sink structure 40 (see FIGS. 10 and 11). The low profile transverse heat sink structure 40 is formed as an assemblage of the following components: two each of a low profile heat sink base 35, four each of a low profile outer folded-fin component 36 and two each of a low profile inner folded-fin component 37.

The alteration to the transverse heat sink structure 20 shown in FIGS. 10 and 11 is achieved by elongating (in the Z direction) the transversally oriented rib section of the heat sink base 23, resulting in the low profile heat sink base 35. In a similar fashion, the inner folded-fin component 25 and the outer folded-fin component 24 are shortened (in the X direction), resulting in the low profile inner folded-fin component 37 and the low profile outer folded-fin component 36.

This embodiment provides similar thermal dissipation performance to that of the transverse heat sink structure 20 while providing the desired low profile form factor.

As described previously, waste heat originally generated by the LED die array 32 is transferred outwardly from opposite sides (sides parallel to the XY plane) of the axial thermal transfer member 26 into the pair of heat sink bases 23 where the waste heat is first conducted into the three sided channel sections and then into the transversely oriented rib sections. The three sided channel sections serve to conduct heat into the inner folded-fin components 25, while the transversely oriented rib section serves to conduct heat into the outer folded-fin components 24.

In this way, waste heat generated by the LED die array 32 is rapidly dissipated throughout the transverse heat sink structure 20.

As previously described, the external component group 60 operates in conjunction with the internal component group 50 in the following ways: it creates and maintains thermal contact (both transverse and axial) between the components that comprise the internal component group 50; it protects the internal components from damaging external forces (both transverse and axial) and it evacuates waste heat from the transverse heat sink structure 20 into the ambient environment.

In a preferred embodiment of the present invention, the external component group 60 (shown in FIG. 9) is comprised of the following components: an exterior housing, in and of itself comprised of two each of an exterior half-shell 14, four each of a half-shell fastener 19, an exterior top plate 12, four each of a top plate fastener 15, an exterior bottom plate 13 and three each of a bottom plate fastener 18; six each of a transverse compression pad 21 (comprised of an adhesive backed elastomer material), two each of a transverse heat sink spacer 22 (comprised of an adhesive backed elastomer material), an axial compression load system, in and of itself comprised of an axial compression plate 27, an axial compression spring 28, an axial compression pad 29 (comprised of an elastomer material), an axial compression clamp 33 and two each of an axial compression fastener 34; and an axial flow fan 17.

Elements of the external component group 60 operate in conjunction with the internal component group 50 in the following way: with the six transverse compression pads 21 adhered to the inside surfaces of the exterior half-shells 14 (surfaces parallel to the XY plane, see FIG. 7) and with the two transverse heat sink spacers 22 adhered to the appropriate inside surfaces of the exterior half-shells 14 (surfaces parallel to the YZ plane), the exterior shells are brought together around the internal component group 50 such that a transverse compression load (applied through the central axis of the transverse heat sink structure 20, parallel to the YZ plane) is developed between the exterior half-shells 14, the transverse compression pads 21, the transverse heat sink structure 20 and the axial thermal transfer member 26, insuring that sufficient thermal contact is created between the transverse heat sink structure 20 and the axial thermal transfer member 26.

Figure 1:
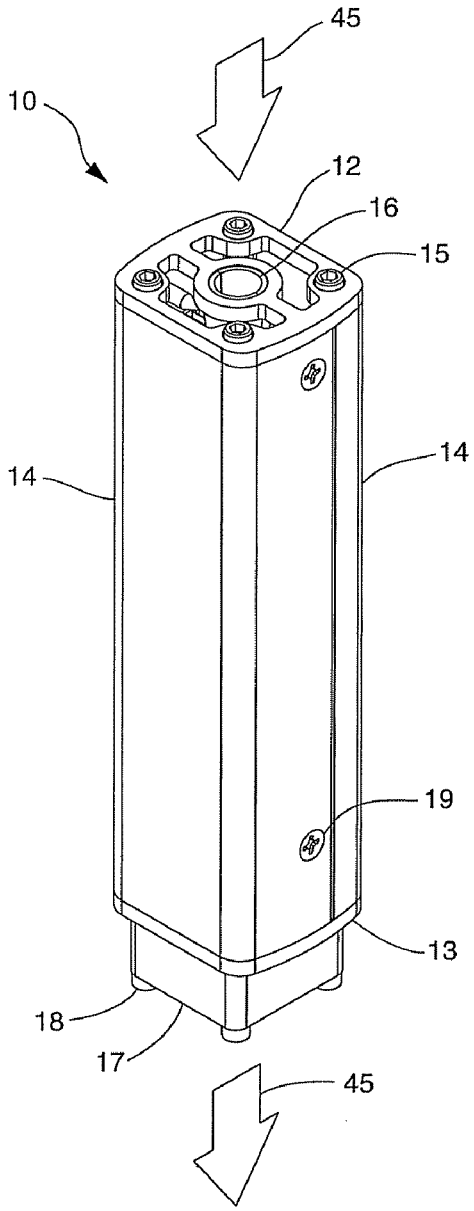
FIG. 1 is a perspective view of a high intensity solid state lighting apparatus in accordance with the present invention.
Figure 2:
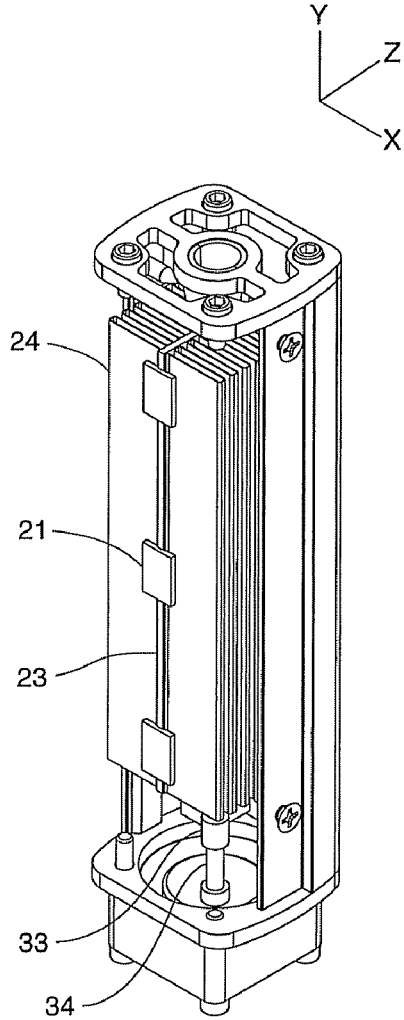
FIG. 2 is a modified perspective view (a cover has been removed to expose internal components) of a high intensity solid state lighting apparatus in accordance with the present invention.
Figure 3:
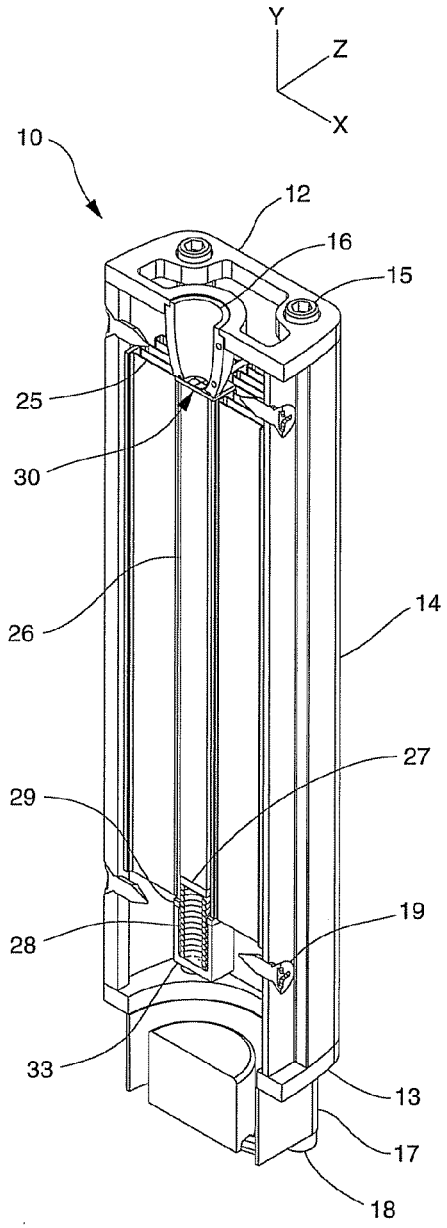
FIG. 3 is a modified perspective view (vertically sectioned) of a high intensity solid state lighting apparatus in accordance with the present invention.
Figure 4:
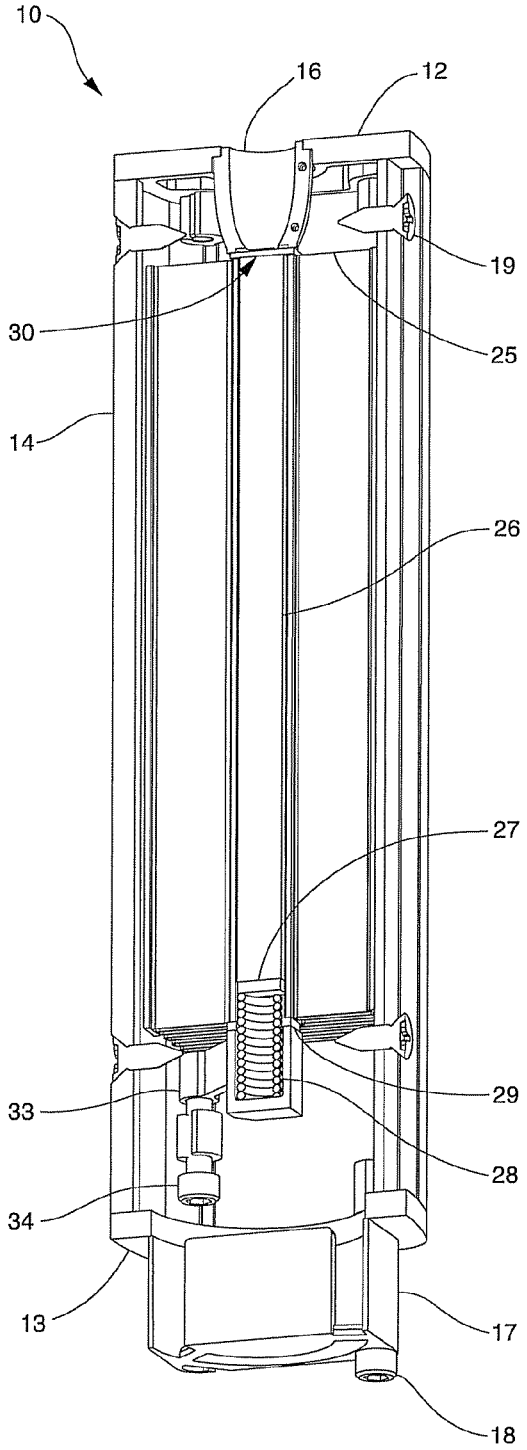
FIG. 4 is a modified version of FIG. 3 (rotated and enlarged for clarity)

So arranged, the exterior half-shells 14 are fastened to each other with the four half-shell fasteners 19 (see FIGS. 1 and 2). Secured in this way, the two exterior half-shells 14 form a single, tubular structure around the internal component group 50, thereby maintaining thermal contact (transversally oriented) between the transverse heat sink structure 20 and the axial thermal transfer member 26 while protecting said internal component group from transversely oriented external forces (transverse to the central axis of the axial thermal transfer member 26).

The external component group 60 also protects the internal component group 50 from axially oriented external forces, as well as serving to create and maintain thermal contact (axially oriented) between the LED die array and circuit structure assembly 30 and the axial thermal transfer member 26. This is achieved by utilizing the remaining exterior housing components, the exterior top plate 12, the top plate fasteners 15, the exterior bottom plate 13 and the bottom plate fasteners 18, along with an axial compression load system, as described in more detail below.

With the exterior half-shells 14, the transverse compression pads 21 and the transverse heat sink spacers 22 secured around the internal component group 50, as previously described, the exterior top plate 12 is fastened to the exterior half-shells 14 with the top plate fasteners 15.

Subsequently, an axial compression load system, comprised of the axial compression plate 27, the axial compression spring 28, the axial compression pad 29, the axial compression clamp 33 and the two axial compression fasteners 34 is assembled into the partial exterior housing assembly (partial in that the exterior bottom plate 13 is yet to be assembled) in the following way: the axial compression plate 27 is inserted into a channel in the transverse heat sink structure 20 that has been formed by the three sided channel sections of the heat sink bases 23, such that the axial compression plate 27 is placed against the end face of the axial thermal transfer member 26. The end of the axial compression spring 28 is then placed into the channel, such that the end of the axial compression spring 28 is placed against the axial compression plate 27. The axial compression pad 29 is placed around the axial compression spring 28 and against the end face of the transverse heat sink structure 20 (the end face being formed by the three sided channel sections of the heat sink bases 23).

The axial compression clamp 33 is placed over and around the axial compression spring 28 (there being a pocket in the axial compression clamp). The axial compression spring 28 is compressed by a translation of the axial compression clamp 33 (in the Y direction) such that the outer arms of the axial compression clamp 33 are made to clear the axial clamp fastener retention features in the exterior half-shells 14 (see FIG. 4). The axial compression clamp 33 is then rotated (about the central axis of the axial thermal transfer member 26) and released such that the outer arms of the axial compression clamp 33 are aligned with the axial clamp fastener retention features in the exterior half-shells 14. The two axial compression fasteners 34 are then threaded into the axial clamp fastener retention features in the exterior half-shells 14 such that the axial compression clamp 33 is forced away from said axial clamp fastener retention features, thereby compressing the axial compression spring 28 and the axial compression pad 29.

This axial compression loading serves two purposes. It eliminates axial end play between the internal component group 50 and the exterior top plate 12 and it eliminates axial end play between the axial thermal transfer member 26 and the LED die array and circuit structure assembly 30. The axial compression loading thereby insures sufficient thermal contact between the axial thermal transfer member 26 and the LED die array and circuit structure assembly 30.

So arranged, the exterior bottom plate 13 and the axial flow fan 17 are fastened to the exterior half-shells 14 with the three bottom plate fasteners 18.

The axial flow fan 17 is part of an active, forced convection cooling system, whereby a fluid medium, in the present case air, is forced through the transverse heat sink structure 20 out into the ambient environment, as shown by the direction indicator 45 in FIG. 1.

In this way, the external component group 60 serves to evacuate waste heat from the transverse heat sink structure 20 into the ambient environment and to protect the internal component group 50 from damaging external forces.

In another embodiment of the present invention, the high intensity solid state lighting apparatus 10 could be integrated into a broader purpose device (e.g. an image projector) by integrating the external component group 60, or a group of components that provide the functioning thereof, into the broader purpose device.

In other embodiments of the present invention, the evacuation of waste heat from the high intensity solid state lighting apparatus 10 could be achieved by means other than forced convection, as outlined heretofore. Other methods include: liquid cooling, dual phase, closed loop cooling (e.g., heat pipes) and passive convection cooling.

These other means of thermal transfer are commonly known in the art and are mentioned here so as not to limit the present invention to a single method of waste heat evacuation.

What is claimed is:

1. A high intensity solid state lighting apparatus comprising:

an elongated axial thermal transfer member having first and second opposed ends and a longitudinal axis, said member being formed of a solid material having a thermal conductivity along said axis that is substantially greater than its thermal conductivity in a first plane transverse to said axis, having a thermal conductivity in a second plane transverse to the first plane that is substantially the same as its thermal conductivity along said axis, and being formed of a highly oriented pyrolytic graphite material comprised of a plurality of generally parallel graphene layers that are generally parallel to the second plane of said axial thermal transfer member;

at least one light emitting diode (LED) mounted at said first end of said axial thermal transfer member so that heat generated by said LED is conducted along said axis toward the second end of said axial thermal transfer member, and an optic element mounted relative to said LED for receiving light emitted by said LED and distributing said light into a desired angle of illumination.

2. The lighting apparatus of claim 1 further including a thermally conductive circuit structure interposed between said LED and said first end of said axial thermal transfer member.

3. The light apparatus of claim 1 in which said optic element is a reflective optic element that reflects the light from said LED into the desired angle of illumination.

4. The lighting apparatus of claim 1 further including a transverse heat sink structure mounted to opposite sides of said axial thermal transfer member along its axis to dissipate heat from said axial thermal transfer member.

5. The lighting apparatus of claim 4 in which said transverse heat sink structure comprises first and second complementary heat sink components that are secured together so as to encase therebetween said axial thermal transfer member.

6. The lighting apparatus of claim 4 in which said transverse heat sink structure has a finned construction to facilitate the dissipation of heat from said axial thermal transfer member.

7. The lighting apparatus of claim 1 in which said at least one LED comprises a relatively closely spaced array of a plurality of LEDs.

8. The lighting apparatus of claim 4 in which said transverse heat sink structure has a width along the second plane of said axial thermal transfer member that is substantially equal to its depth along the first plane of said axial thermal transfer member so as to give said lighting apparatus a compact, substantially axial form factor.

9. The lighting apparatus of claim 4 in which said transverse heat sink structure has a width along the second plane of said axial thermal transfer member that is substantially greater than its depth along the first plane of said axial thermal transfer member so as to give said lighting apparatus a compact, substantially low profile form factor.

10. The lighting apparatus of claim 4 further including an external housing comprising first and second complementary housing components that are secured together so as to encase said axial thermal member and said transverse heat sink structure of said lighting apparatus therebetween.

11. The lighting apparatus of claim 10 further including compression fasteners for securing said first and second complementary housing components together and maintaining a compression load on said housing components transverse to the second plane of said axial thermal transfer member.

12. The lighting apparatus of claim 10 further including first and second end caps for covering openings at opposite ends of said first and second housing components.

13. The lighting apparatus of claim 12 further including compression fasteners for securing said first and second end caps to said housing components and maintaining a compression load on said first and second end caps along the axis of said axial thermal transfer member.

14. The lighting apparatus of claim 10 further including a fan mounted to one end of said external housing for moving cooling fluid through said housing.

15. A solid state heat dissipation apparatus comprising:

(a) an elongated axial thermal transfer member having first and second opposed ends and a longitudinal axis, said member having a thermal conductivity along its axis and in a first plane transverse to its axis that is substantially greater than its thermal conductivity in a second plane transverse to said first plane;

(b) at least one solid state component mounted at said first end of said axial thermal transfer member so that heat generated by said component is conducted along the axis toward the second end, and along said first plane, of said axial thermal transfer member; and (c) a transverse heat sink structure mounted to opposite sides of said axial thermal transfer member along its axis to dissipate heat from said axial thermal transfer member.

16. The heat dissipation apparatus of claim 15 in which said axial thermal transfer member is formed of a highly oriented pyrolythic graphic material comprised of a plurality of generally parallel graphene layers that are generally parallel to the first plane of said member.

17. The heat dissipation apparatus of claim 15 further including a thermally conductive circuit structure interposed between said at least one solid state component and said first end of said axial thermal transfer member.

18. The heat dissipation apparatus of claim 15 wherein said at least one solid state component comprises at least one light emitting diode (LED).

19. The heat dissipation apparatus of claim 18 further including an optic element mounted relative to said LED for receiving light emitted by said LED and distributing light into a desired angle of illumination.

20. The heat dissipation apparatus of claim 15 in which said transverse heat sink structure comprises first and second complimentary heat sink components that are secured together so as to encase therebetween said axial thermal transfer member.

21. The heat dissipation apparatus of claim 15 in which said transverse heat sink structure has a finned construction to facilitate the dissipation of heat from said axial thermal transfer member.

22. The heat dissipation apparatus of claim 15 further including an external housing comprising first and second complimentary housing components that are secured together so as to encase said axial thermal member and said transfer heat sink structure.

23. The heat dissipation apparatus of claim 22 further including compression fasteners for securing said first and second housing components together and maintaining a compression load on said housing components.

24. The heat dissipation apparatus of claim 22 further including first and second end caps for covering openings at opposite ends of said first and second housing components.

25. The heat dissipation apparatus of claim 24 further including compression fasteners for securing said first and second end caps to said housing components and maintaining a compression load on said first and second end caps along said axis of said axial thermal transfer member.

26. The heat dissipation apparatus of claim 22 further including a fan mounted to one end of said external housing for moving cooling fluid through said housing.

* * * * *